US006241538B1

(12) United States Patent
Chen

(10) Patent No.: US 6,241,538 B1
(45) Date of Patent: Jun. 5, 2001

(54) POWER SUPPLY PLUG STRUCTURE FOR A NOTEBOOK COMPUTER

(75) Inventor: Yung-Chung Chen, Feng Yung (TW)

(73) Assignee: GME-Tech Co., Ltd., Taichung Hsien (TW)

( * ) Notice: Subject to any disclaimer, the term of this patent is extended or adjusted under 35 U.S.C. 154(b) by 0 days.

(21) Appl. No.: 09/590,356

(22) Filed: Jun. 8, 2000

(51) Int. Cl.[7] ..... H01R 13/44
(52) U.S. Cl. ..... 439/131
(58) Field of Search ..... 439/535, 901, 439/915, 131; 174/53; 200/43.22

(56) References Cited

U.S. PATENT DOCUMENTS 4,702,007 * 10/1987 Nomura et al. ..... 439/131
5,006,779 * 4/1991 Fenne et al. ..... 439/131
6,098,886 * 7/2000 Mareno ..... 439/131

* cited by examiner

*Primary Examiner*—Neil Abrams
*Assistant Examiner*—J. F. Duverne
(74) *Attorney, Agent, or Firm*—Charles E. Baxley, Esq.

(57) ABSTRACT

A power supply plug structure for a notebook computer includes a housing, two elongated sheet-shaped connecting legs, and two conducting pieces. An operation space is formed in the housing and has two sides each defining a receiving recess. Two opposite pivot holes are each defined in the operation space. Each of the two connecting legs is pivotally mounted in the receiving recess and includes a rotation shaft having two ends each having a pivot axle received in the pivot hole of the housing. A drive gear is mounted on the rotation shaft, and a conducting hook is integrally formed on the rotation shaft. Each of the conducting pieces detachably contacts with the conducting hook when the two connecting legs are pivoted to a fixed position. A plurality of meshing driven gears each mesh with the drive gear of the rotation shaft of each of the two connecting legs.

8 Claims, 7 Drawing Sheets

POWER SUPPLY PLUG STRUCTURE FOR A NOTEBOOK COMPUTER

BACKGROUND OF THE INVENTION

1. Field of the Invention

The present invention relates to a power supply plug structure, and more particularly to a power supply plug structure for a notebook computer.

2. Description of the Related Art

A conventional notebook computer in accordance with the prior art shown in FIG. 1 primarily comprises a computer body 10, a box-shaped voltage processing member 11, and an extension plug 12 having two prongs 13. However, the voltage processing member 11 and the extension plug 12 are exposed outward of the computer body 10, thereby taking up much space. In addition, the prongs 13 are fixed on the extension plug 12 and cannot be folded so that the prongs 13 will occupy space and are easily worn out.

SUMMARY OF THE INVENTION

In accordance with one aspect of the present invention, there is provided a power supply plug structure for a notebook computer comprising: a housing including an upper cover and a lower cover coupled with each other, an operation space formed in a front end of the housing and having two sides each defining a receiving recess, two opposite pivot holes each defined in an inner side of the operation space; two elongated sheet-shaped connecting legs each pivotally mounted in the receiving recess of the housing, each of the two connecting legs including a rotation shaft rotatably mounted in the operation space of the housing and having two ends each having a pivot axle extending outward and received in the pivot hole of the housing, a drive gear mounted on the rotation shaft of each of the two connecting legs, and a conducting hook integrally formed on the rotation shaft of each of the two connecting legs; two conducting pieces each secured in the housing and each detachably contacting with the conducting hook of the rotation shaft of each of the two connecting legs when the two connecting legs being pivoted to a fixed position; and a plurality of meshing driven gears each mounted in the housing and each meshing with the drive gear of the rotation shaft of each of the two connecting legs.

Further benefits and advantages of the present invention will become apparent after a careful reading of the detailed description with appropriate reference to the accompanying drawings.

DETAILED DESCRIPTION OF THE INVENTION

Figure 1:
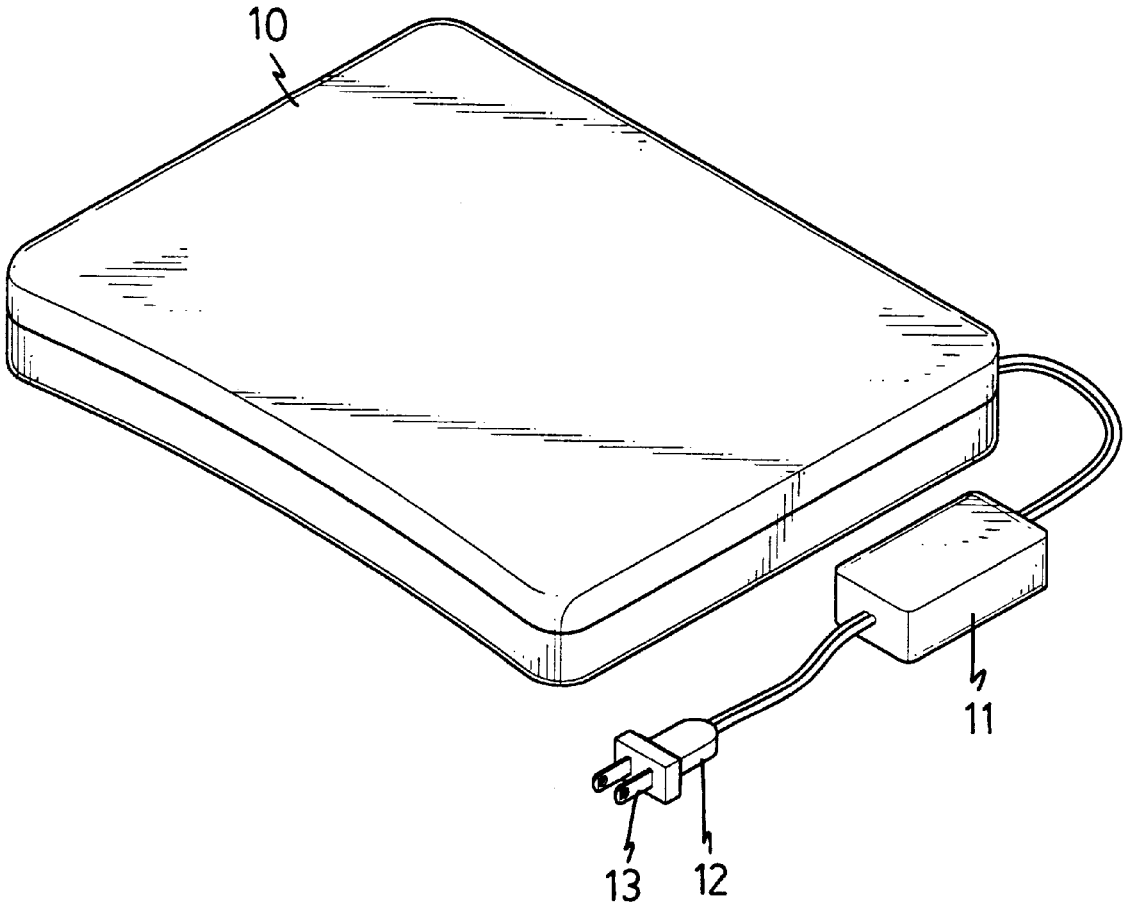
FIG.1 PRIOR ART
FIG. 1 is a perspective view of a conventional notebook computer in accordance with the prior art.

Referring to the drawings and initially to FIGS. 2–5, a power supply plug structure used for a notebook computer in accordance with the present invention comprises a housing including an upper cover 20 and a lower cover 30 securely coupled with each other, two elongated sheet-shaped connecting legs 60, a circuit board 40, two conducting pieces 41, and two driven gears 50.

An upper operation space 21 is formed in the front end of the upper cover 20 of the housing and has two sides each defining an upper receiving recess 22. Two opposite upper pivot holes 24 are each defined in the inner side of the upper operation space 21.

A lower operation space 31 is formed in the front end of the lower cover 30 of the housing and has two sides each defining a lower receiving recess 32. Two opposite lower pivot holes 33 are each defined in the inner side of the lower operation space 31.

Each of the two connecting legs 60 is pivotally mounted in the housing and includes a rotation shaft 61 having two ends each having a pivot axle 611 extending outward and rotatably received in the upper pivot hole 24 of the upper cover 20 and the lower pivot hole 33 of the lower cover 30. A drive gear 64 is integrally formed on the rotation shaft 61 of each of the two connecting legs 60. An L-shaped conducting hook 63 is integrally formed on the rotation shaft 61 of each of the two connecting legs 60.

Each of the two conducting pieces 41 is secured on the circuit board 40 located in the housing, and detachably contacts with the conducting hook 63 of the rotation shaft 61 of each of the two connecting legs 60 when the two connecting legs 60 are pivoted to a fixed position.

Figure 7:
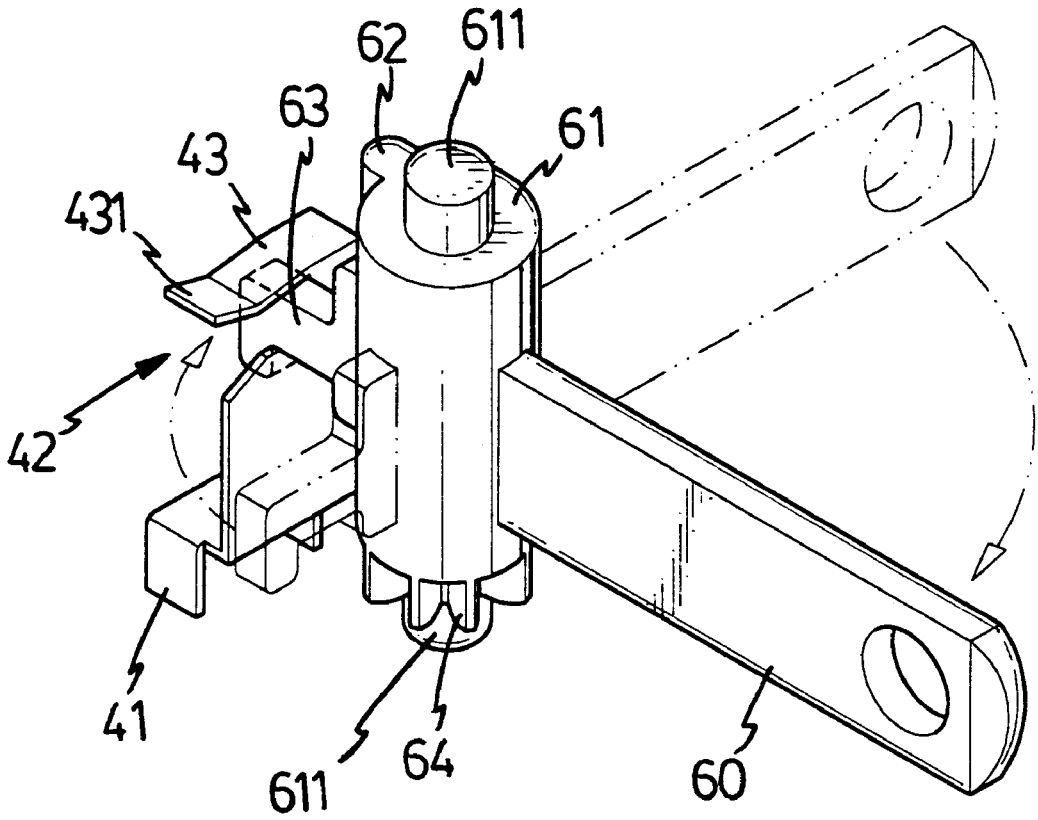
FIG. 7 is a perspective operational view of the power supply plug structure as shown in FIG. 2.

As shown in FIG. 7, each of the two conducting pieces 41 has one side laterally defining an opening 42 for detachably receiving the conducting hook 63 of the rotation shaft 61 of each of the two connecting legs 60 when the two connecting legs 60 is pivoted to the fixed position thereof. Each of the two conducting pieces 41 also includes a contact plate 43 located on the top portion of the opening 42 and detachably contacting with the conducting hook 63 of the rotation shaft 61 of each of the two connecting legs 60. The contact plate 43 of each of the two conducting pieces 41 includes a distal end 431 extending upward in an inclined manner.

Figure 5:
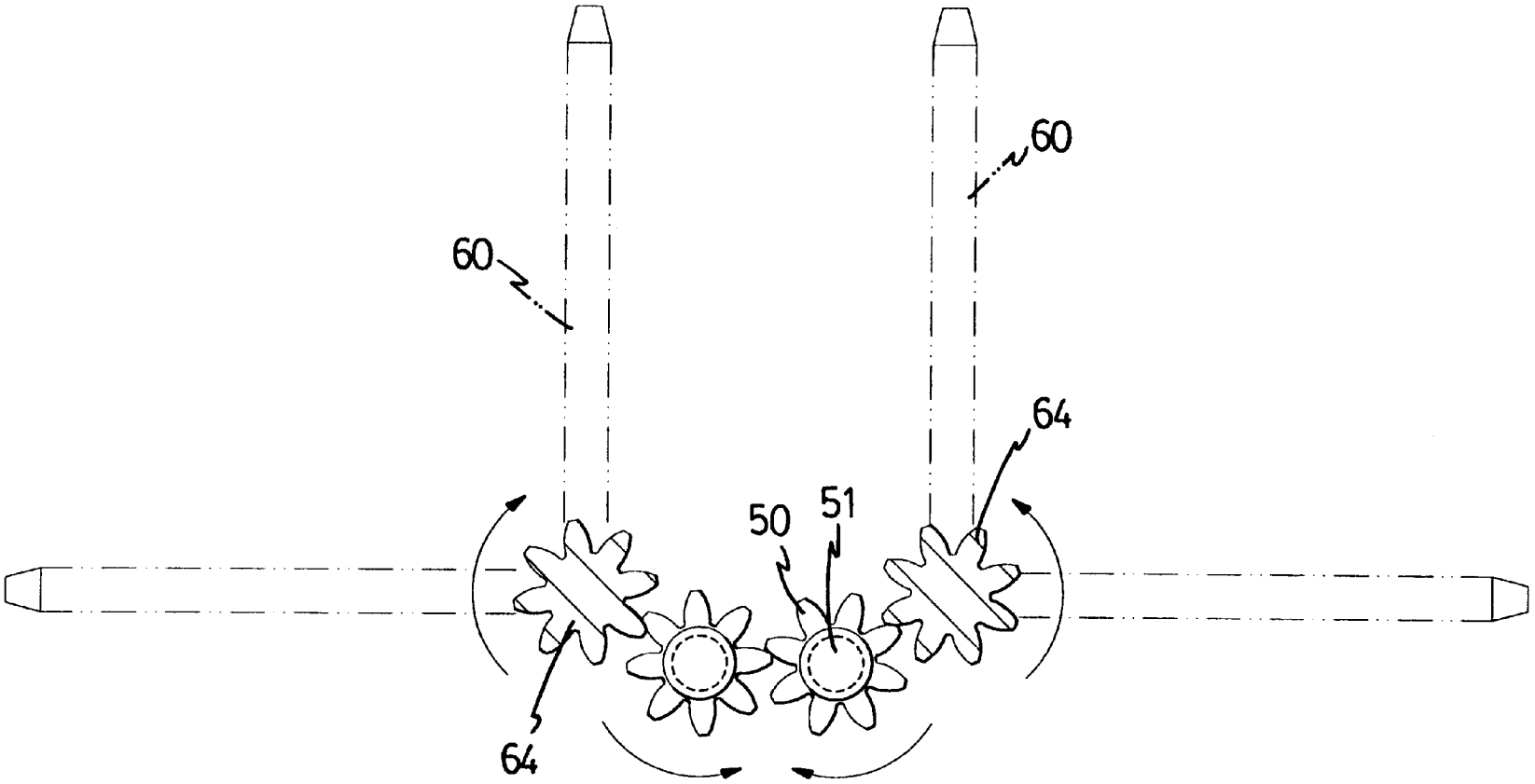
FIG. 5 is a partially enlarged view of the power supply plug structure as shown in FIGS. 3 and 4.

Each of the two meshing driven gears 50 is rotatably mounted on the lower cover 30, and meshes with the drive gear 64 of the rotation shaft 61 of each of the two connecting legs 60 as shown in FIG. 5. The lower cover 30 includes a plurality of gear pivot holes 34 defined in the lower operation space 31 thereof. A plurality of pivot pins 51 each extend through a corresponding one of the driven gears 50 and are each secured in a corresponding one of the gear pivot holes 33 so that each of the driven gears 50 is rotatably mounted in the lower cover 30 of the housing.

Figure 2:
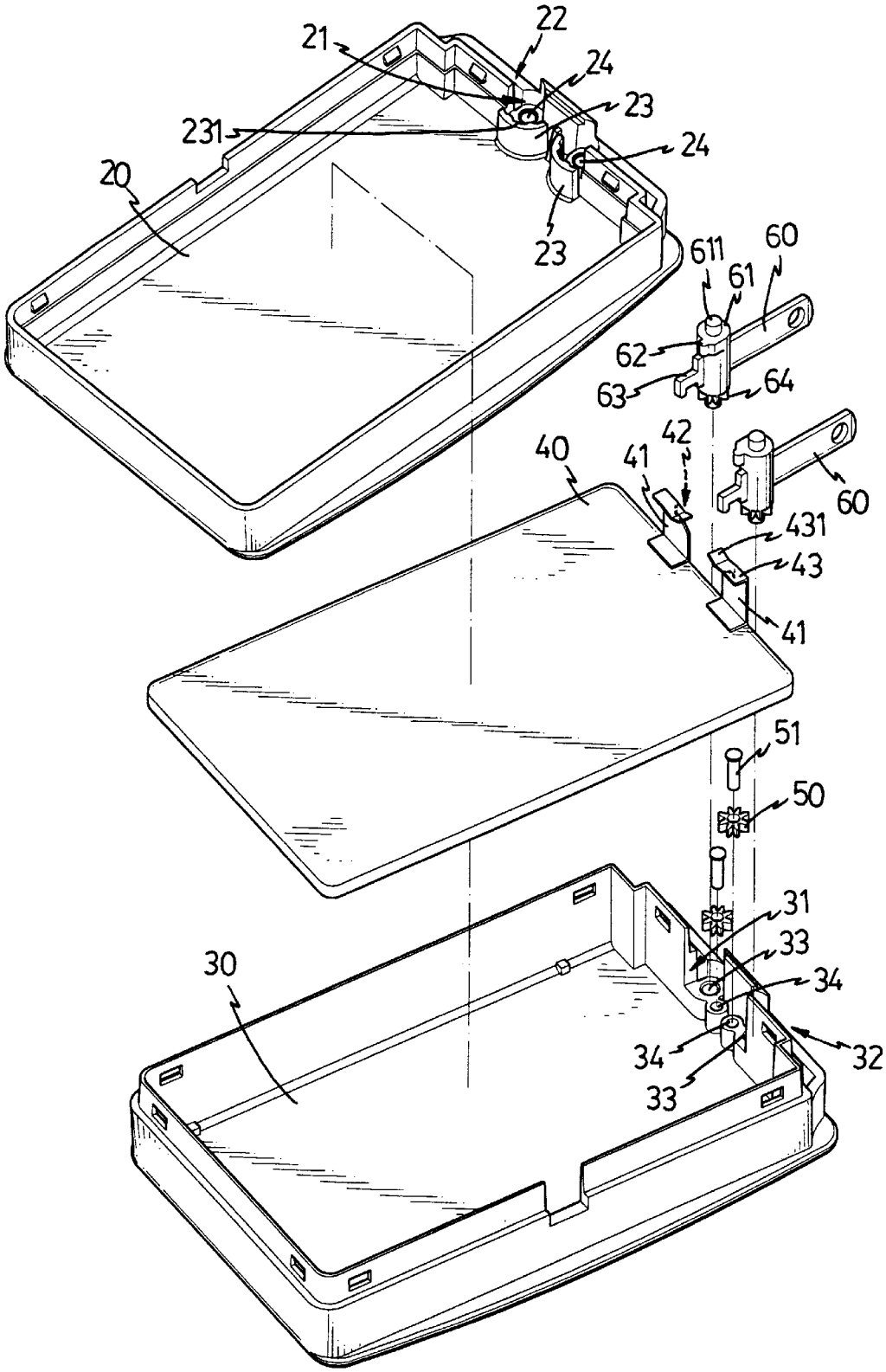
FIG. 2 is an exploded view of a power supply plug structure for a notebook computer in accordance with the present invention.
Figure 6:
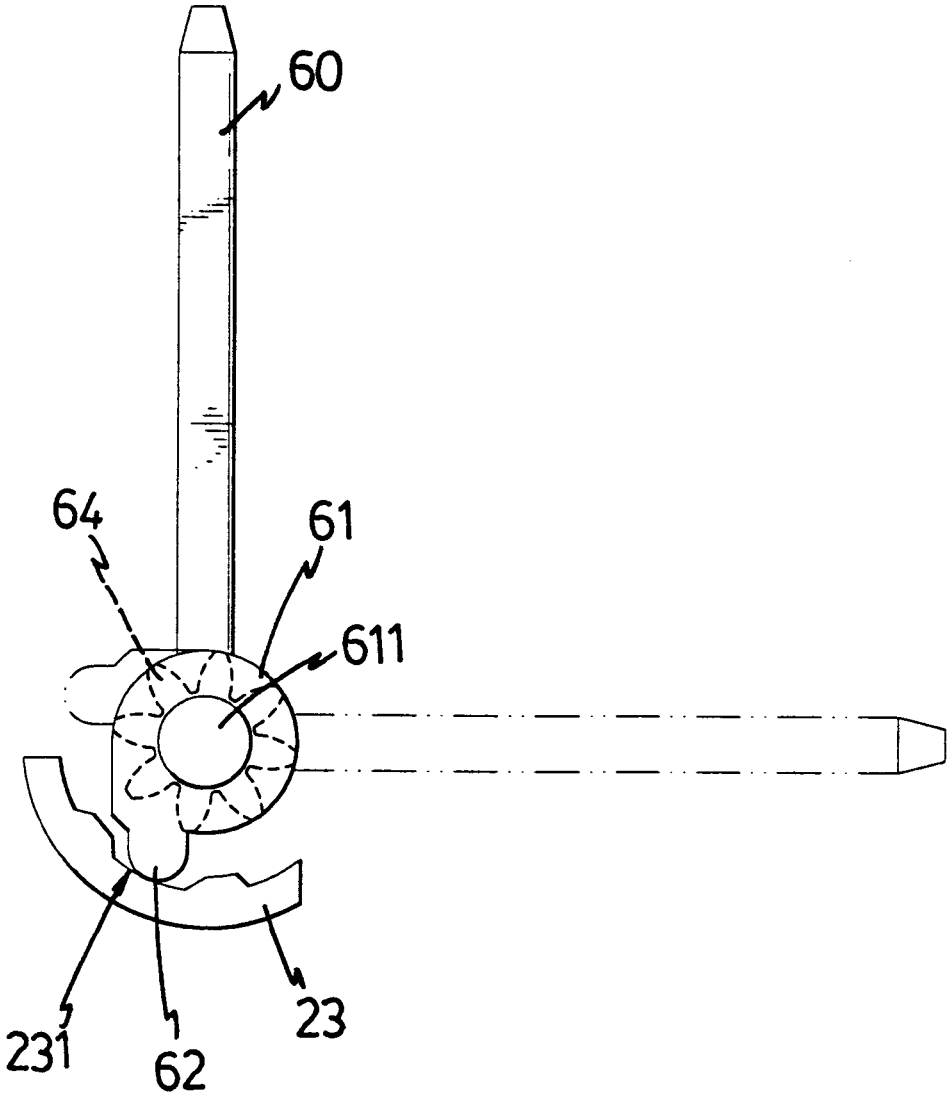
FIG. 6 is a partially cut-away top plan operational view of the power supply plug structure as shown in FIG. 2.

As shown in FIGS. 2 and 6, the rotation shaft 61 of each of the two connecting legs 60 is integrally formed with a positioning rib 62 extending outward. Two arcuate positioning blocks 23 are each secured in the upper operation space 21 of the upper cover 20, and each define a retaining groove 231 for detachably securing the positioning rib 62 of the rotation shaft 61 of each of the two connecting legs 60 therein.

Figure 3:
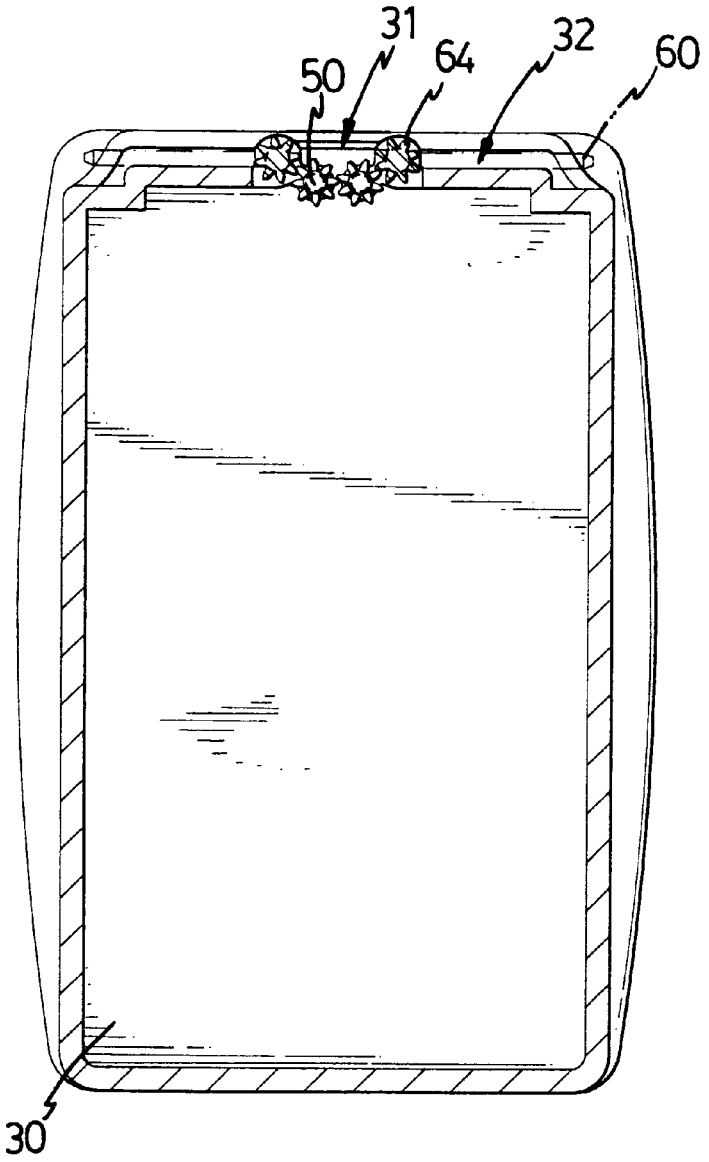
FIG. 3 is a top plan cross-sectional assembly view of the power supply plug structure as shown in FIG. 2.

In operation, each of the two connecting legs 60 is initially received in the upper receiving recess 22 of the upper cover 20 and the lower receiving recess 32 of the lower cover 30 as shown in FIG. 3 so that the two connecting legs 60 of the power supply plug structure can be hidden in the notebook computer without protruding outward from the housing, thereby enhancing the appearance of the notebook computer, and thereby facilitating the user folding the power supply plug structure.

Figure 4:
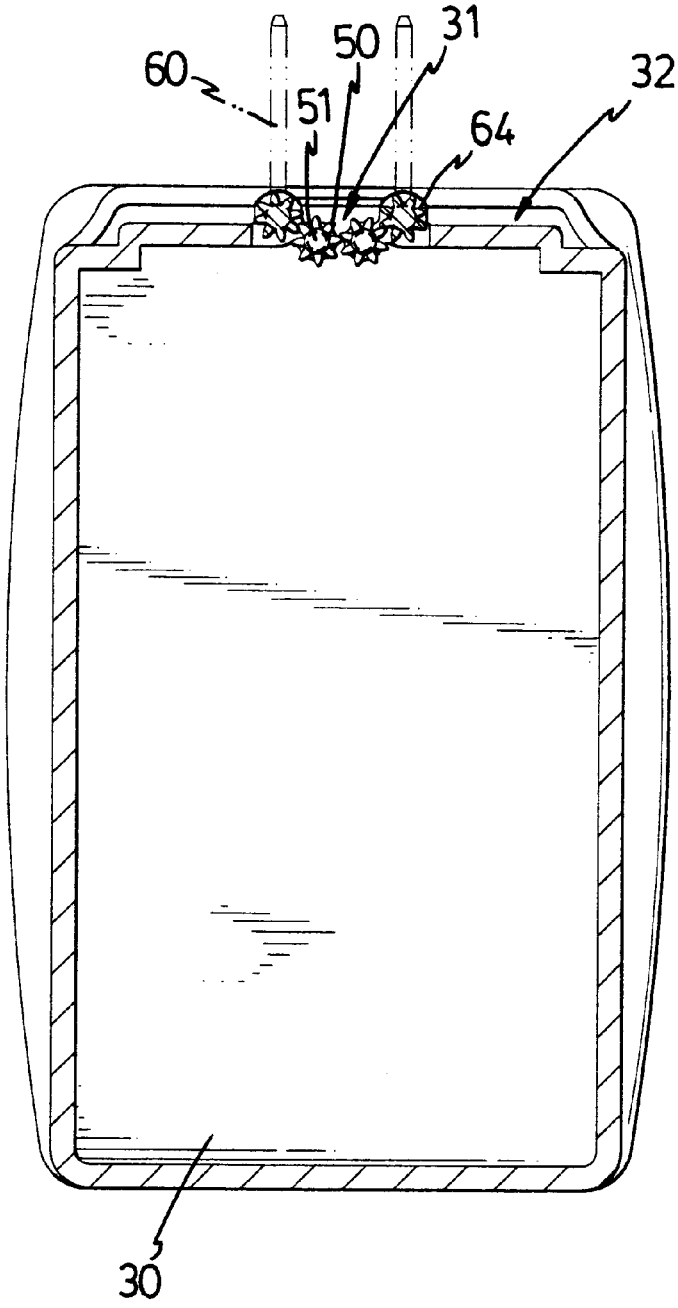
FIG. 4 is an operational view of the power supply plug structure as shown in FIG. 3.

The user can then pull and pivot one of the two connecting legs 60 outward to rotate the rotation shaft 61 which rotates the drive gear 64 which in turn rotates the two driven gears 50 which then rotate the drive gear 64 of the rotation shaft 61 of the other connecting leg 60 as best shown in FIG. 5 so that the two connecting legs 60 can be pivoted simultaneously from the position as shown in FIG. 3 to the position as shown in FIG. 4 to be oriented in parallel with each other so as to function as an electric plug.

It is appreciated that, the two drive gears 64 of the rotation shafts 61 are rotated at the same speed in an opposite direction by means of the two driven gears 50 as shown in FIG. 5. Therefore, the user only needs to pivot one of the two connecting legs 60 so as to drive and pivot the other connecting leg 60 synchronously so that the two connecting legs 60 can be easily extended and folded at the same time, thereby facilitating operating the two connecting legs 60.

At the same time, the positioning rib 62 of the rotation shaft 61 of each of the two connecting legs 60 is secured in the retaining groove 231 of the arcuate positioning block 23 of the upper operation space 21 of the upper cover 20 as shown in FIG. 6 so that the two connecting legs 60 can be secured by the positioning block 23 temporarily.

When the two connecting legs 60 are parallel disposed at the position as shown in FIG. 4, the conducting hook 63 is rotated with the rotation shaft to be inserted into the opening 42 to contact the contact plate 43 of the conducting piece 41 as shown in FIG. 7 so that the electric current can be supplied from the connecting legs 60 to the conducting pieces 41 through the conducting hook 63 which is in connection with the contact plate 43. The inclined distal end 431 of the contact plate 43 is used for facilitating the conducting hook 63 entering the opening 42 of the conducting piece 41. Then, the current is delivered into the circuit board 40 through the conducting pieces 41, and into a rectifying circuit (not show) of the notebook computer.

It should be clear to those skilled in the art that further embodiments may be made without departing from the scope of the present invention.

What is claimed is:

1. A power supply plug structure for a notebook computer comprising:

a housing including an upper cover and a lower cover coupled with each other, an operation space formed in a front end of said housing and having two sides each defining a receiving recess, two opposite pivot holes each defined in an inner side of said operation space;

two elongated sheet-shaped connecting legs each pivotally mounted in said receiving recess of said housing, each of said two connecting legs including a rotation shaft rotatably mounted in said operation space of said housing and having two ends each having a pivot axle extending outward and received in said pivot hole of said housing, a drive gear mounted on said rotation shaft of each of said two connecting legs, and a conducting hook integrally formed on said rotation shaft of each of said two connecting legs;

two conducting pieces each secured in said housing and each detachably contacting with said conducting hook of said rotation shaft of each of said two connecting legs when said two connecting legs being pivoted to a fixed position; and a plurality of meshing driven gears each mounted in said housing and each meshing with said drive gear of said rotation shaft of each of said two connecting legs.

2. The power supply plug structure in accordance with claim 1, further comprising a circuit board mounted in said housing for supporting each of said two conducting pieces.

3. The power supply plug structure in accordance with claim 1, wherein each of said two conducting pieces has one side defining an opening for detachably receiving said conducting hook of said rotation shaft of each of said two connecting legs when said two connecting legs is pivoted to a fixed position.

4. The power supply plug structure in accordance with claim 3, wherein each of said two conducting pieces includes a contact plate located on a top portion of said opening and detachably contacting with said conducting hook of said rotation shaft of each of said two connecting legs.

5. The power supply plug structure in accordance with claim 4, wherein said contact plate of each of said two conducting pieces includes a distal end extending upward in an inclined manner.

6. The power supply plug structure in accordance with claim 1, wherein said rotation shaft of each of said two connecting legs is integrally formed with a positioning rib extending outward, and said power supply plug structure further comprises two arcuate positioning blocks each secured in said operation space of said housing and each defining a retaining groove for detachably securing said positioning rib of said rotation shaft of each of said two connecting legs therein.

7. The power supply plug structure in accordance with claim 1, wherein said conducting hook of said rotation shaft of each of said two connecting legs is L-shaped.

8. The power supply plug, structure in accordance with claim 1, wherein said housing includes a plurality of gear pivot holes defined in said operation space, and said power supply plug structure further comprises a plurality of pivot pins each extending through a corresponding one of said driven gears and each secured in a corresponding one of said gear pivot holes so that each of said driven gears is rotatably mounted in said housing.

* * * * *